US008627976B2

(12) United States Patent
Anderson

(10) Patent No.: US 8,627,976 B2
(45) Date of Patent: Jan. 14, 2014

(54) CART WITH LATCH

(75) Inventor: Barry Anderson, Sheboygan, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 34 days.

(21) Appl. No.: 13/195,235

(22) Filed: Aug. 1, 2011

(65) Prior Publication Data

US 2013/0032597 A1 Feb. 7, 2013

(51) Int. Cl.

*B65D 43/26* (2006.01)
*B65D 45/20* (2006.01)
*B65F 1/14* (2006.01)

(52) U.S. Cl.

CPC ..... *B65F 1/163* (2013.01); *B65F 1/1623* (2013.01)
USPC ..... 220/264; 220/326

(58) Field of Classification Search

CPC ..... B65F 1/163; B65F 1/1623; B65F 1/16; B65F 1/1615; B65F 1/1646
USPC ..... 220/326, 324, 315, 830, 827, 810, 220/908.1, 908, 264, 263, 262, 254.6, 220/254.5, 254.3, 254.1; D34/9, 8, 7
IPC ..... B65D 43/26, 43/22, 45/20, 45/16
See application file for complete search history.

(56) References Cited

U.S. PATENT DOCUMENTS

| | | | | |
|---|---|---|---|---|
| 1,164,583 | A | 12/1915 | Drapalik | |
| 1,199,531 | A | 9/1916 | Davis | |
| 1,350,713 | A * | 8/1920 | Ferdon | 292/247 |
| 1,455,133 | A | 5/1923 | Downs | |
| 1,580,880 | A | 4/1926 | Frisbie | |
| 2,456,840 | A * | 12/1948 | Rogers et al. | 220/263 |
| 2,667,320 | A | 1/1954 | Whitley | |
| 3,041,030 | A | 6/1962 | Heimrich | |
| 3,064,931 | A | 11/1962 | Rowe | |
| 3,137,408 | A | 6/1964 | Taylor | |
| 3,208,706 | A | 9/1965 | Clark | |
| 3,275,363 | A | 9/1966 | Bates et al. | |
| 3,347,507 | A | 10/1967 | Dyer | |
| 4,164,178 | A | 8/1979 | Baumann et al. | |
| 4,883,189 | A | 11/1989 | Lobbert | |

(Continued)

FOREIGN PATENT DOCUMENTS

| | | | |
|---|---|---|---|
| GB | 2323020 | 9/1998 | |
| WO | WO 9631416 | 10/1996 | |
| WO | WO 0009410 A1 * | 2/2000 | B65D 43/26 |

OTHER PUBLICATIONS

International Search Report and Written Opinion for Application No. PCT/US2012/049024 dated Oct. 19, 2012 (12 pages).

*Primary Examiner* — Robert J Hicks
(74) *Attorney, Agent, or Firm* — Michael Best & Friedrich LLP

(57) ABSTRACT

A cart including a container that defines an interior space. The cart also includes a cover that is movable between an open position providing access to the interior space and a closed position inhibiting access to the interior space, and a latch that is located between the container and the cover to releasably hold the cover in the closed position. The cart further includes a hands-free mechanism that is coupled to the container and engaged with the cover to move the cover between the open position and the closed position. The hands-free mechanism is further coupled to the latch and operable to disengage the latch to permit movement of the cover to the open position.

31 Claims, 15 Drawing Sheets

(56) References Cited

U.S. PATENT DOCUMENTS

| | | | | |
|---|---|---|---|---|
| 5,048,712 | A | 9/1991 | Wolters | |
| 5,143,389 | A | 9/1992 | Jonkers | |
| 5,163,574 | A | 11/1992 | Sosan | |
| D332,852 | S | 1/1993 | Delmerico | |
| 5,195,649 | A | 3/1993 | Wolters | |
| 5,213,382 | A | 5/1993 | Dawdy et al. | |
| 5,230,525 | A | 7/1993 | Delmerico et al. | |
| 5,236,135 | A | 8/1993 | Wilson et al. | |
| 5,354,023 | A | 10/1994 | Meeks | |
| 5,415,315 | A | 5/1995 | Ramirez | |
| 5,465,841 | A | 11/1995 | Wilson et al. | |
| 5,474,201 | A | 12/1995 | Liu | |
| 5,507,408 | A | 4/1996 | Mosior et al. | |
| 5,531,346 | A | 7/1996 | Mosior | |
| 5,531,348 | A | 7/1996 | Baker et al. | |
| 5,558,254 | A | 9/1996 | Anderson et al. | |
| 5,611,451 | A | 3/1997 | Mosior et al. | |
| 5,613,574 | A | 3/1997 | Melanson | |
| 5,641,171 | A | 6/1997 | Posey et al. | |
| 5,881,896 | A | 3/1999 | Presnell et al. | |
| 6,010,024 | A | 1/2000 | Wang | |
| D478,701 | S | 8/2003 | Panek, Jr. | |
| 6,626,316 | B2 | 9/2003 | Yang | |
| 6,626,321 | B2 | 9/2003 | Jaeger | |
| 6,651,992 | B1 | 11/2003 | Smith, Sr. | |
| 7,114,629 | B2 | 10/2006 | Panek, Jr. | |
| 7,364,049 | B2 | 4/2008 | Panek, Jr. | |
| 7,540,652 | B2 | 6/2009 | Krzywdziak et al. | |
| 7,963,414 | B1 * | 6/2011 | Stravitz | 220/264 |
| 2002/0158068 | A1 | 10/2002 | Panek, Jr. | |
| 2003/0183546 | A1 | 10/2003 | Crawford | |
| 2004/0020927 | A1 | 2/2004 | Yang et al. | |
| 2004/0222335 | A1 | 11/2004 | Panek, Jr. | |
| 2005/0194385 | A1 * | 9/2005 | Lu | 220/263 |
| 2005/0218142 | A1 | 10/2005 | Finnestad et al. | |
| 2007/0068942 | A1 | 3/2007 | Smudde | |
| 2007/0266637 | A1 | 11/2007 | McGowan | |
| 2008/0156666 | A1 | 7/2008 | Panek | |
| 2008/0156818 | A1 | 7/2008 | Panek | |
| 2008/0157434 | A1 | 7/2008 | Panek | |
| 2008/0199299 | A1 | 8/2008 | Baader et al. | |
| 2008/0237234 | A1 | 10/2008 | Yang et al. | |
| 2010/0090428 | A1 | 4/2010 | Meers et al. | |

* cited by examiner

CART WITH LATCH

BACKGROUND

The present invention relates generally to a cart including a waste container for disposal of contaminated articles or other refuse. More particularly, the present invention relates to a cart including a waste container, a cover for the container, and a latch for holding the cover closed.

Most waste containers include a cover that is positioned over an interior space of the container. Generally, the cover is manipulatable between an open position allowing disposal of waste, and a closed position limiting access to the interior space. Sometimes, it is desirable to move or transport these containers to provide more space in a particular area or to empty the containers. However, these existing covers can be inadvertently opened if the container tips over, exposing the contents of the container and possibly spilling the contents of the container into the surrounding area. Such inadvertent exposure can be severely detrimental when the waste container holds biomedical or chemical waste.

SUMMARY

In one construction, the present invention provides a cart including a container that defines an interior space. The cart also includes a cover that is movable between an open position providing access to the interior space and a closed position inhibiting access to the interior space, and a latch that is located between the container and the cover to releasably hold the cover in the closed position. The cart further includes a hands-free mechanism that is coupled to the container and engaged with the cover to move the cover between the open position and the closed position. The hands-free mechanism is further coupled to the latch and operable to disengage the latch to permit movement of the cover to the open position.

In another construction, the cart includes a latch that is coupled to the cover and that has an unlatched state permitting movement of the cover to the open position and a latched state inhibiting movement of the cover to the open position. The cart also includes a hands-free mechanism that is coupled to the container and the latch and that is movable a first distance to vary the latch from the latched state to the unlatched state. The hands-free mechanism is further movable a second distance beyond the first distance to move the cover from the closed position to the open position.

In another construction, the cart includes a latch that is coupled between the container and the cover. The latch is variable between an unlatched state in which the latch is disengaged from one of the container and the cover to permit movement of the cover to the open position, and a latched state in which the latch is engaged with the one of the container and the cover to inhibit movement of the cover to the open position. The cart also includes a caddy that supports the container and that has a hands-free mechanism with a foot pedal operatively coupled to the latch and the cover to vary the latch between the latched state and the unlatched state and to move the cover from the closed position to the open position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
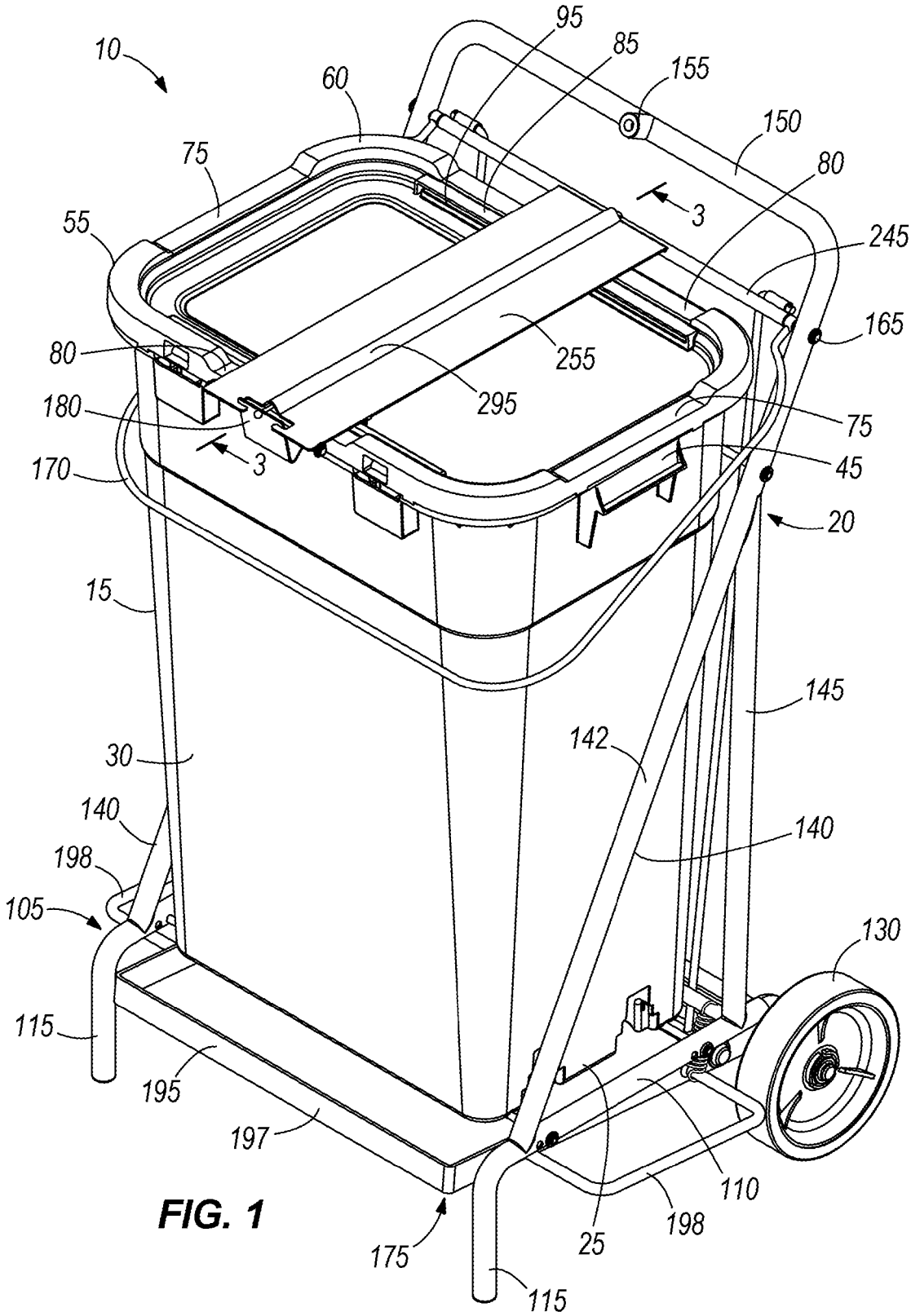
FIG. 1 is a perspective view of a cart embodying the present invention and including a caddy, a container supported on the caddy, and a latch.
Figure 2:
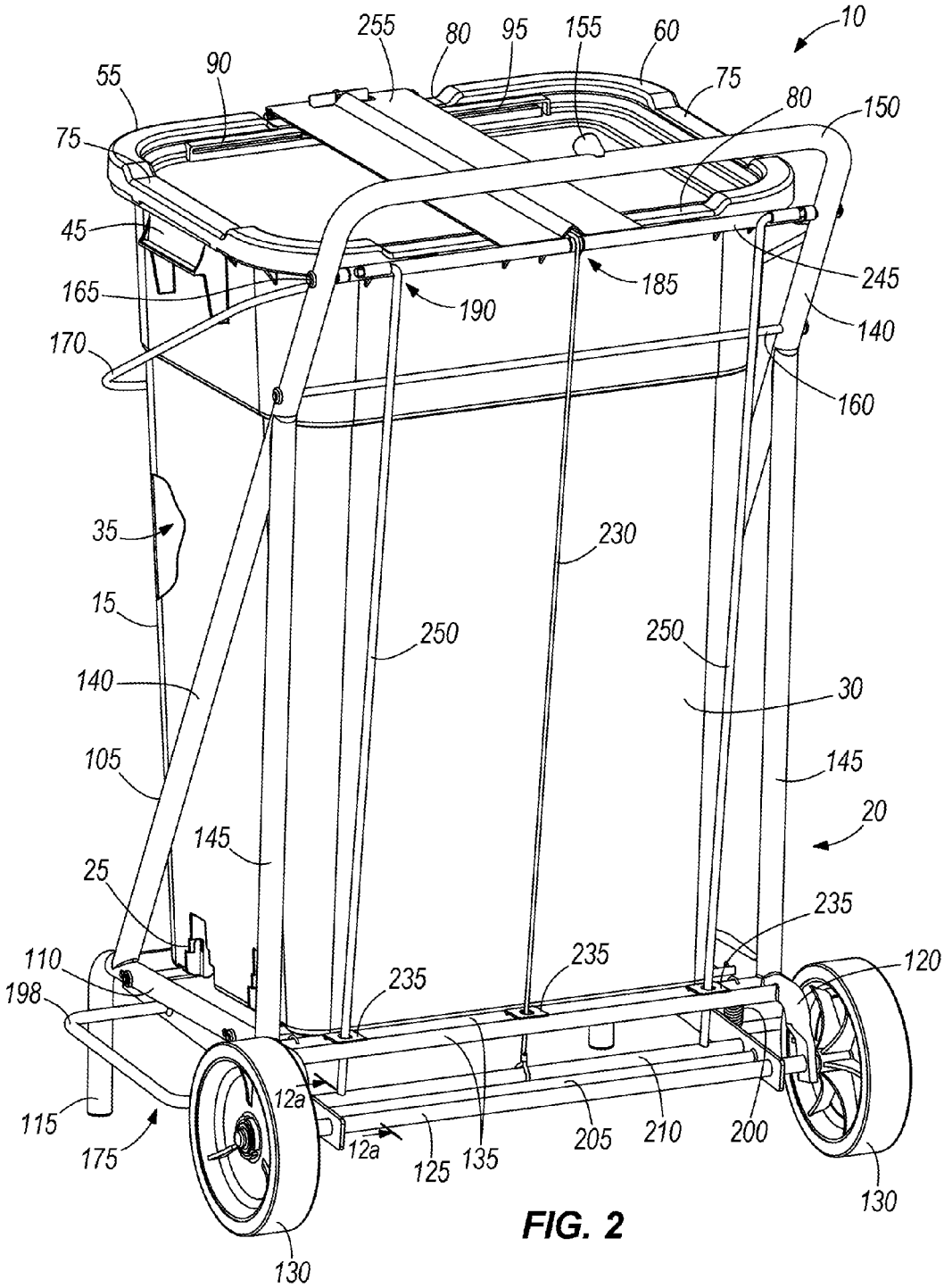
FIG. 2 is another perspective view of the cart of FIG. 1 illustrating a first linkage operatively coupled to the latch and a second linkage operatively engaged with a cover for the container.
Figure 6:
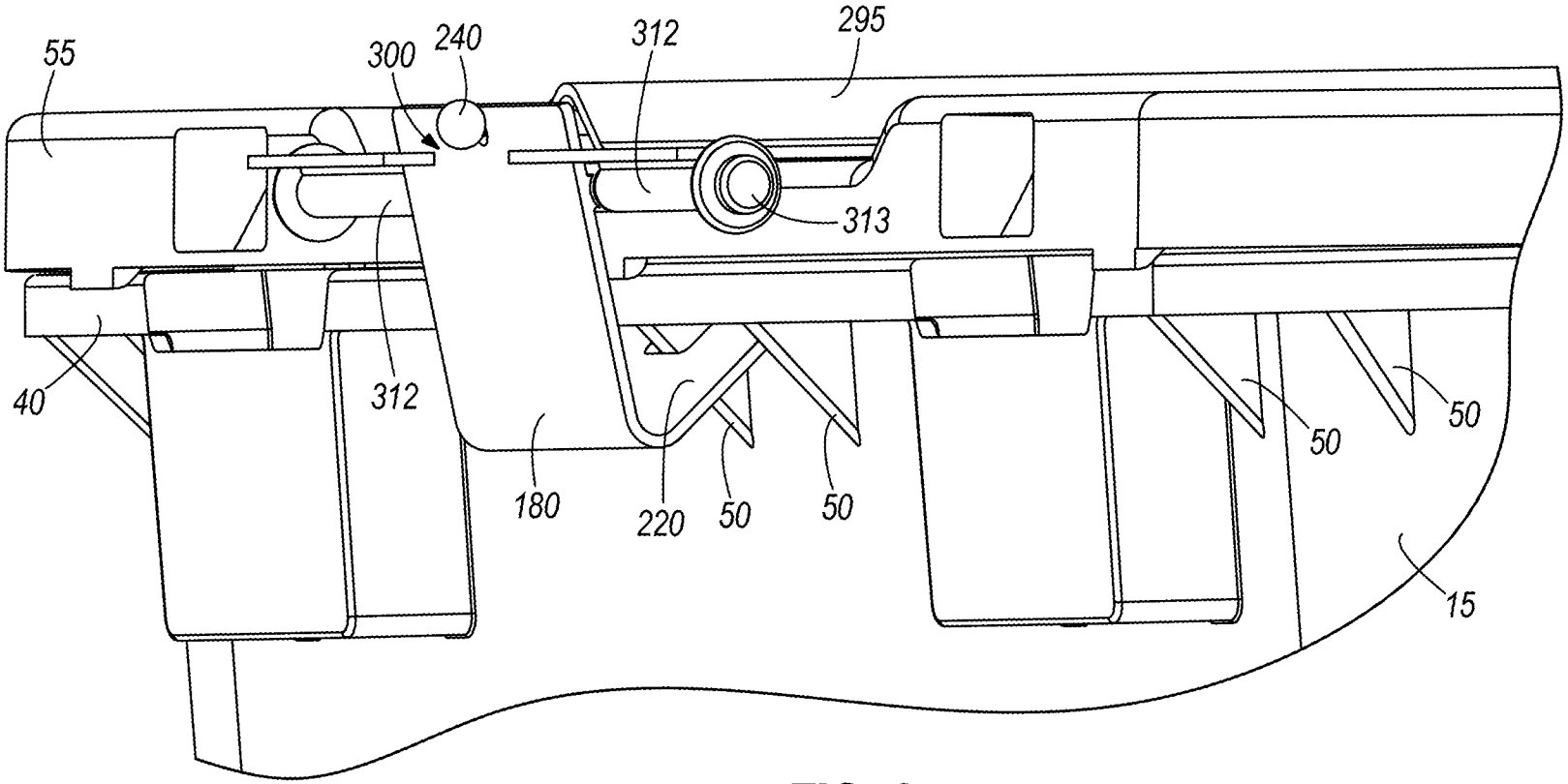
FIG. 6 is a perspective view of an upper portion of the cart showing the latch in a latched state.

FIGS. 1 and 2 show a cart 10 including a container 15 and a caddy 20 for supporting the container 15. The illustrated container 15 is a waste container 15 including a base portion 25 and a sidewall 30 that cooperatively define an interior space 35 for storing contaminated articles or other refuse (e.g., trash, biomedical waste such as sharps objects, bodily fluids, etc.). The top of the sidewall 30 also includes a lip or flange 40 (FIG. 11*a*) that surrounds and defines an opening to the interior space 35. Handles 45 are located on opposite sides of the container 15 adjacent the flange 40 and can be used to move the container 15. With reference to FIG. 6, the container 15 also includes stiffener ribs 50 spaced around the top of the sidewall 30. The ribs 50 extend between the sidewall 30 and the flange 40 to stiffen the flange 40.

Figure 3A:
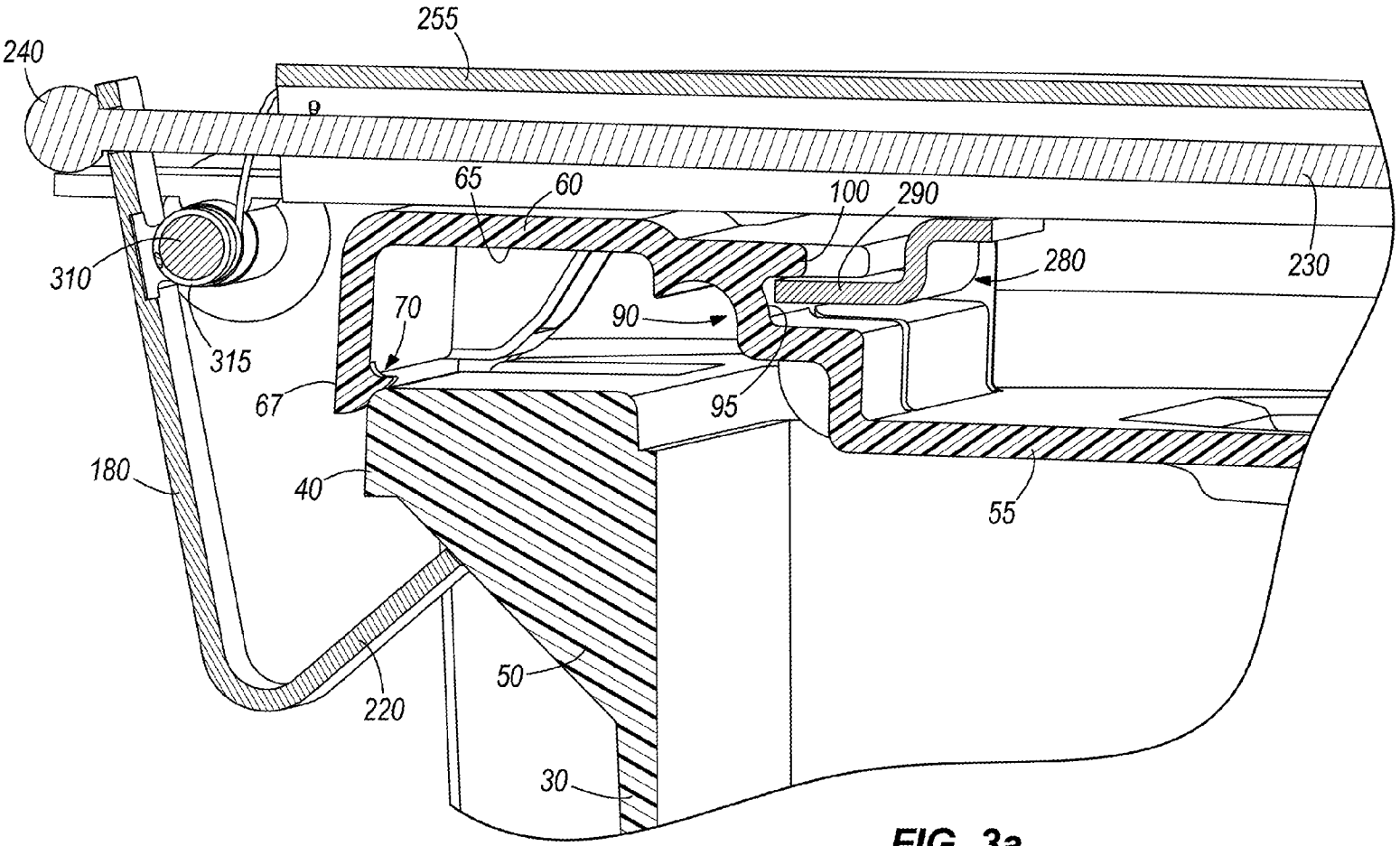
FIG. 3*a* is a section view of a front portion of the cart of FIG. 1 taken along line 3-3 and illustrating a portion of the first linkage and the second linkage.
Figure 3B:
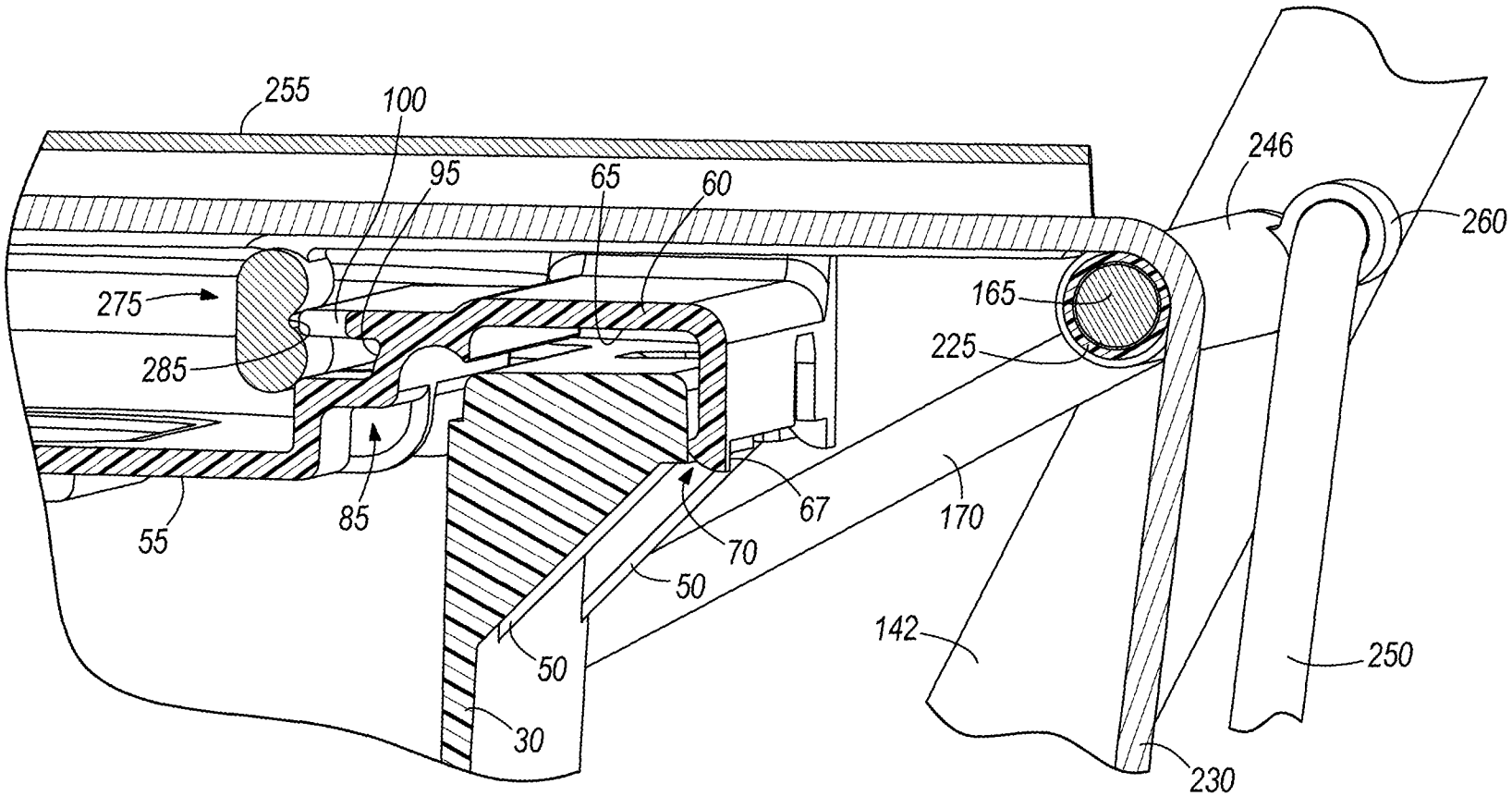
FIG. 3*b* is a section view of a rear portion of the cart of FIG. 1 taken along line 3-3 and illustrating a portion of the first linkage and the second linkage
Figure 8:
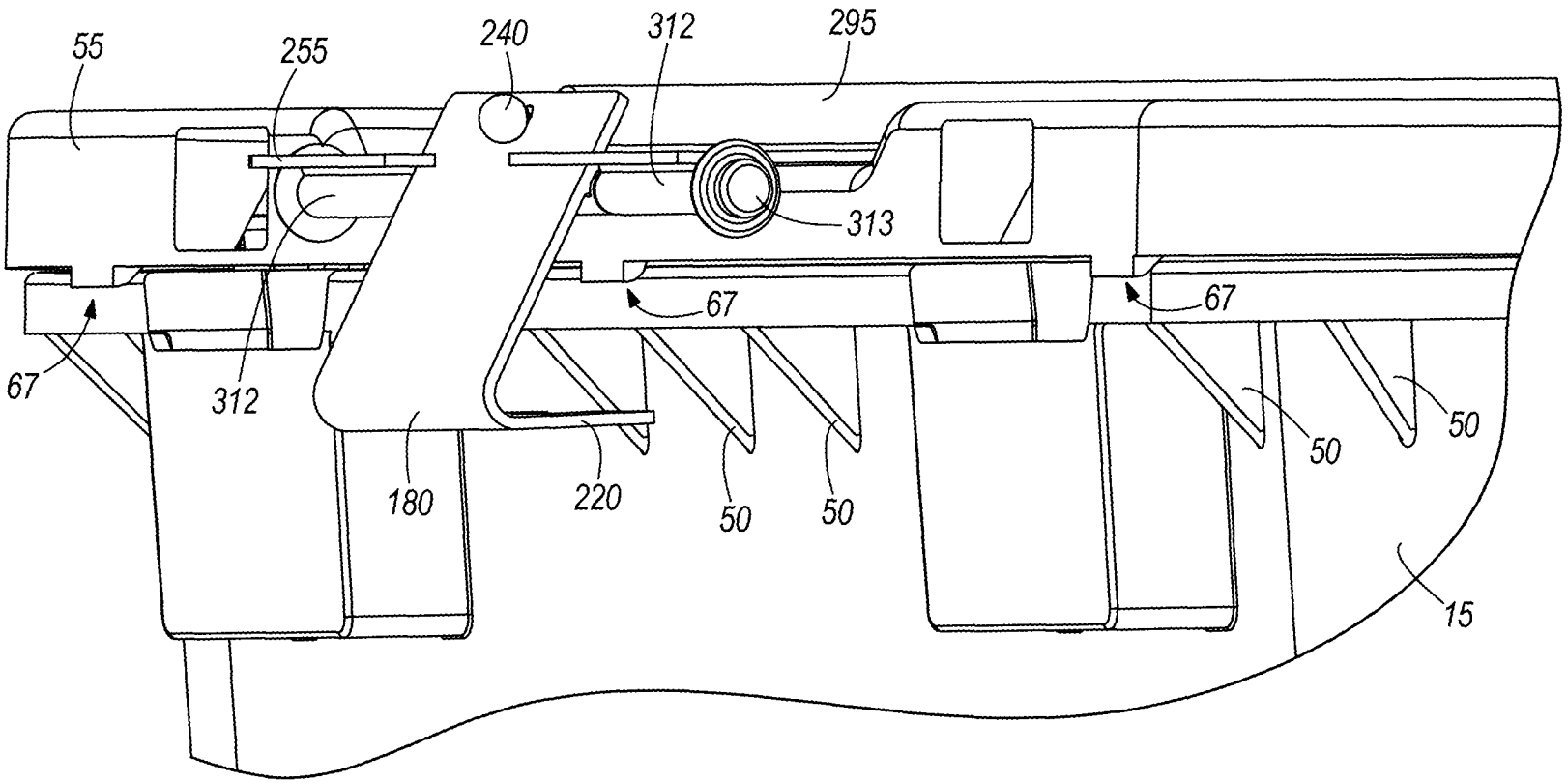
FIG. 8 is a view similar to FIG. 6 showing the latch in an unlatched state.
Figure 9A:
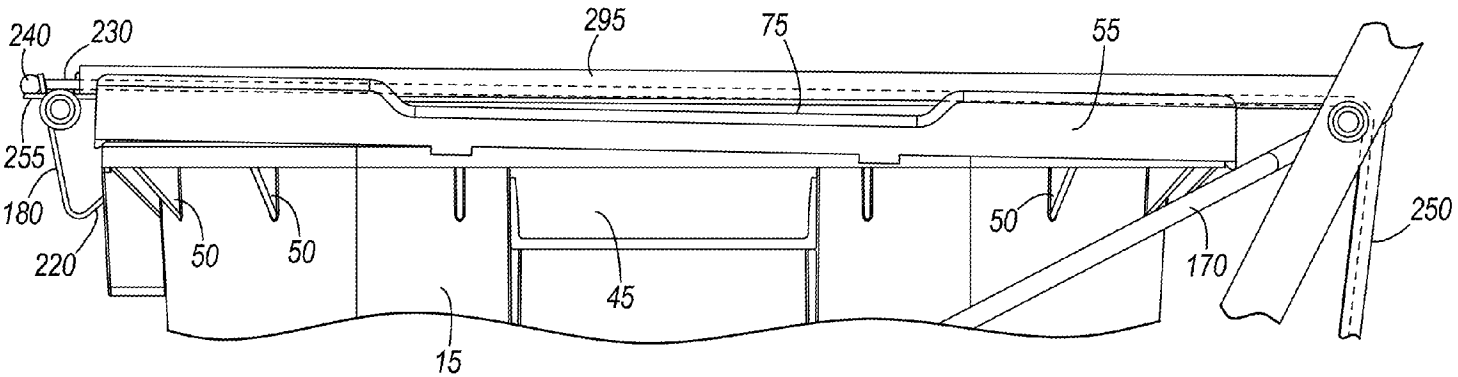
FIG. 9*a* is a side view of the upper portion of the cart showing the latch in the latched state and the cover in a closed position.

With reference to FIGS. 1-3*b* and 6, a cover 55 is seated on the container 15 and engages the flange 40 to enclose the interior space 35. Generally, the cover 55 is movable between an open or removed position (FIG. 11*a*) that provides access to the interior space 35 and a closed position (FIG. 9) that inhibits access to the interior space 35. The cover 55 has a peripheral engagement portion 60 disposed along the outer edge of the cover 55. With reference to FIGS. 3*a*, and 3*b* and 8, the peripheral engagement portion 60 defines a recess or channel 65 shaped to receive the flange 40. A plurality of tabs 67 are disposed on exterior edges of the engagement portion 60 (three on the front and back and two on each side). Each tab 67 has a tapered lip 70 engageable with the underside of the flange 40 to hold the cover 55 in a snapped-down position (e.g., when the container 15 is full). When the cover is in the closed position and pushed down, the tabs 67 flex outward and then snap in when the lips 70 pass the lower edge of the flange 40, such that the upper surfaces of the lips engage the underside of the flange 40. This releasably secures the cover in the snapped-down position. Thus, in the illustrated construction, the "closed position" is not the most secure position of the cover, but is a position in which the interior space is not accessible. In alternative embodiments the "closed position" can also be the most secure or lowermost position.

The peripheral engagement portion 60 of the cover also has (see FIG. 1) first recessed sections 75 that are disposed on opposite sides of the cover 55 and that are aligned with the handles 45, and second recessed sections 80 that are disposed along the front and rearward sides of the cover 55 to accommodate a cover lifting mechanism as explained below. The recessed sections 75 align with the handles 45 when the cover 55 is placed on the container 15 to make it easier to move the container 15 via the handles 45.

The cover 55 also includes a first or rear attachment section 85 (FIGS. 1 and 3*b*) disposed adjacent the rear of the cover 55 along an inward edge of the peripheral engagement portion 60, and a second or front attachment section 90 (FIGS. 2 and 3*a*) disposed adjacent the front of the cover 55 along an inward edge of the peripheral engagement portion 60. Each of the attachment sections 85, 90 has an elongated groove 95 that is defined along an upward edge by an inwardly extending projection 100.

FIGS. 1, 2, 4, and 5 show that the caddy 20 includes a frame 105 for supporting the container 15 in an upright orientation. As illustrated, the frame 105 is tubular, although the frame 105 can be a wireframe or any other type of frame that is suitable for supporting the container 15. The frame 105 includes base frame members 110 for supporting the container 15 and the caddy 20 on a surface (e.g., the floor). In particular, each base frame member 110 has adjacent its forward end a leg 115 engageable with the floor, and each base frame member 110 has an axle support portion 120 adjacent its rearward end. The axle support portions 120 support an axle 125 that rotatably couples wheels 130 to the caddy 20. The legs 115 and the wheels 130 support the caddy 20 on the floor. With reference to FIG. 2, frame supports 135 are coupled to and extend between the base frame members 110 adjacent the rearward ends of the base frame members 110. As illustrated, the frame supports 135 are spaced apart a small distance.

The frame 105 also includes (see FIG. 4) a primary upright frame member 140 that is coupled (e.g., welded) to each of the base frame members 110. The frame member 140 includes side portions 142 that extend upward and rearward from the base frame members 110 adjacent the forward ends of the members 110. The frame member 140 also includes a handle 150 that extends horizontally between the upper ends of the side portions 142. A protrusion or stop 155 is coupled to the handle 150. The frame 105 also includes secondary upright frame members 145 coupled between respective base frame members 110 and respective side portions 142 to provide structural support for the frame member 140. The frame members 140 and 145 limit lateral movement of the container 15 relative to the caddy 20.

Figure 4:
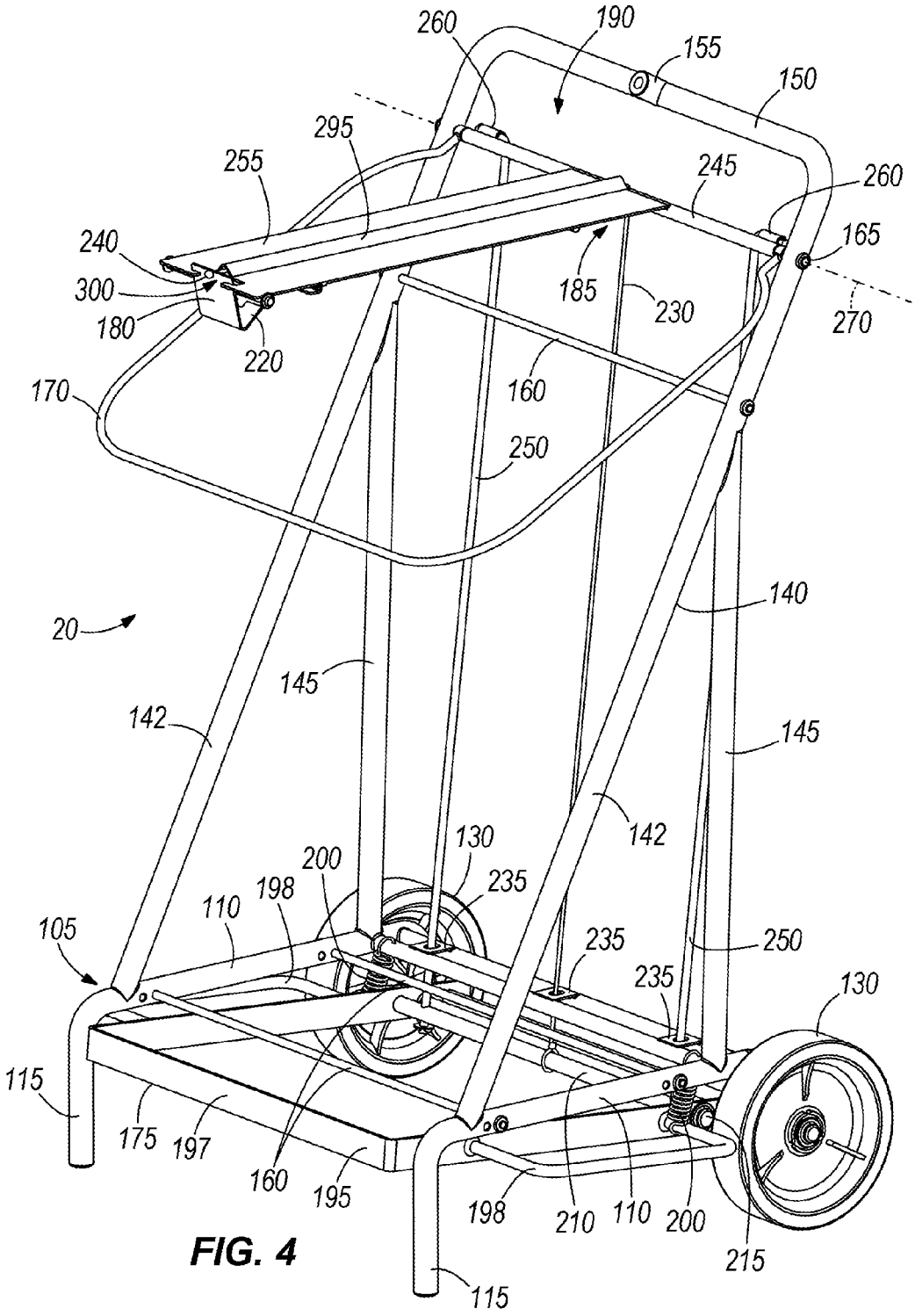
FIG. 4 is a perspective view of the caddy of FIG. 1 including the first linkage and the second linkage.
Figure 9B:
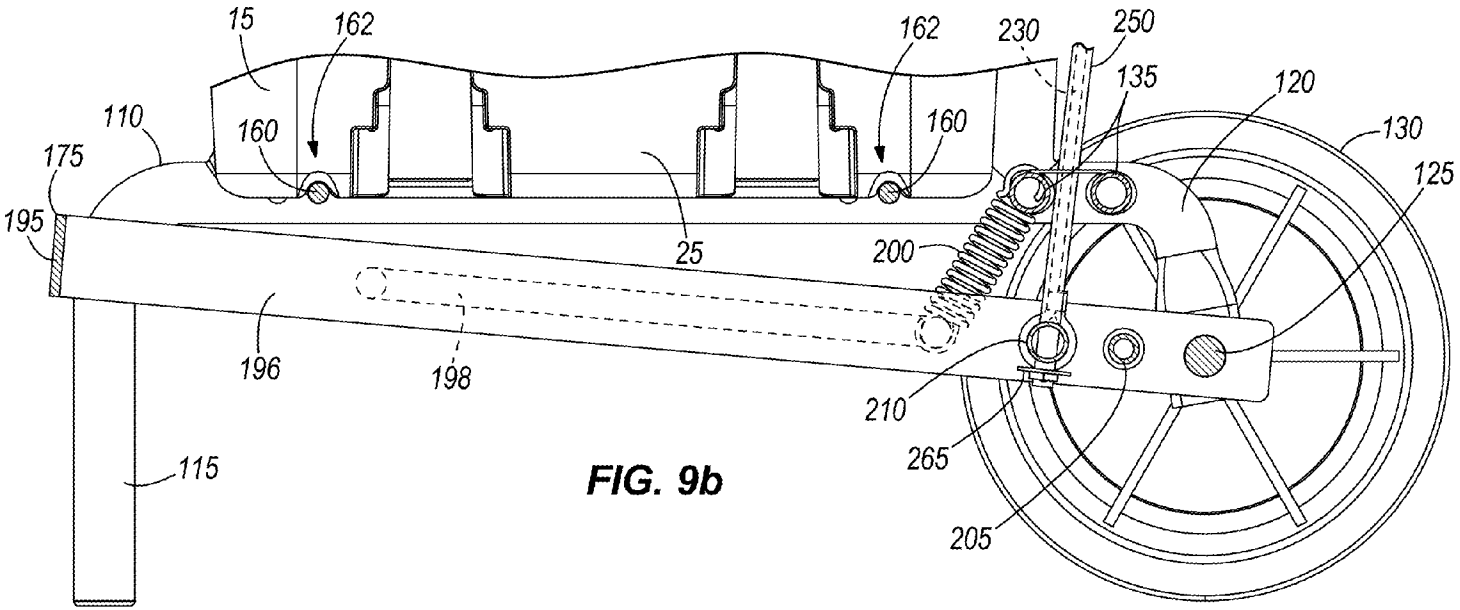
FIG. 9*b* is a section view taken along line 9*b* -9*b* of FIG. 7 showing the lower portion of the cart with a foot pedal in a normal or upper position.

As shown in FIGS. 1 and 2, the base frame members 110, the frame member 140, and the frame members 145 cooperate to define a container support area so that the container 15 is partially surrounded by the frame 105. Container supports 160 (see FIG. 4) are coupled to and extend between the base frame members 110 to support the base portion 25 of the container 15 on the caddy 20. As shown in FIG. 9*b*, the bottom of the container 15 has therein laterally extending grooves 162 in which the supports 160 are seated to limit movement of the container 15 relative to the caddy 20. An upper container support 160 also extends between the side portions 142, as shown in FIG. 4. This upper support 160 limits rearward movement of the container on the caddy.

Figure 5:
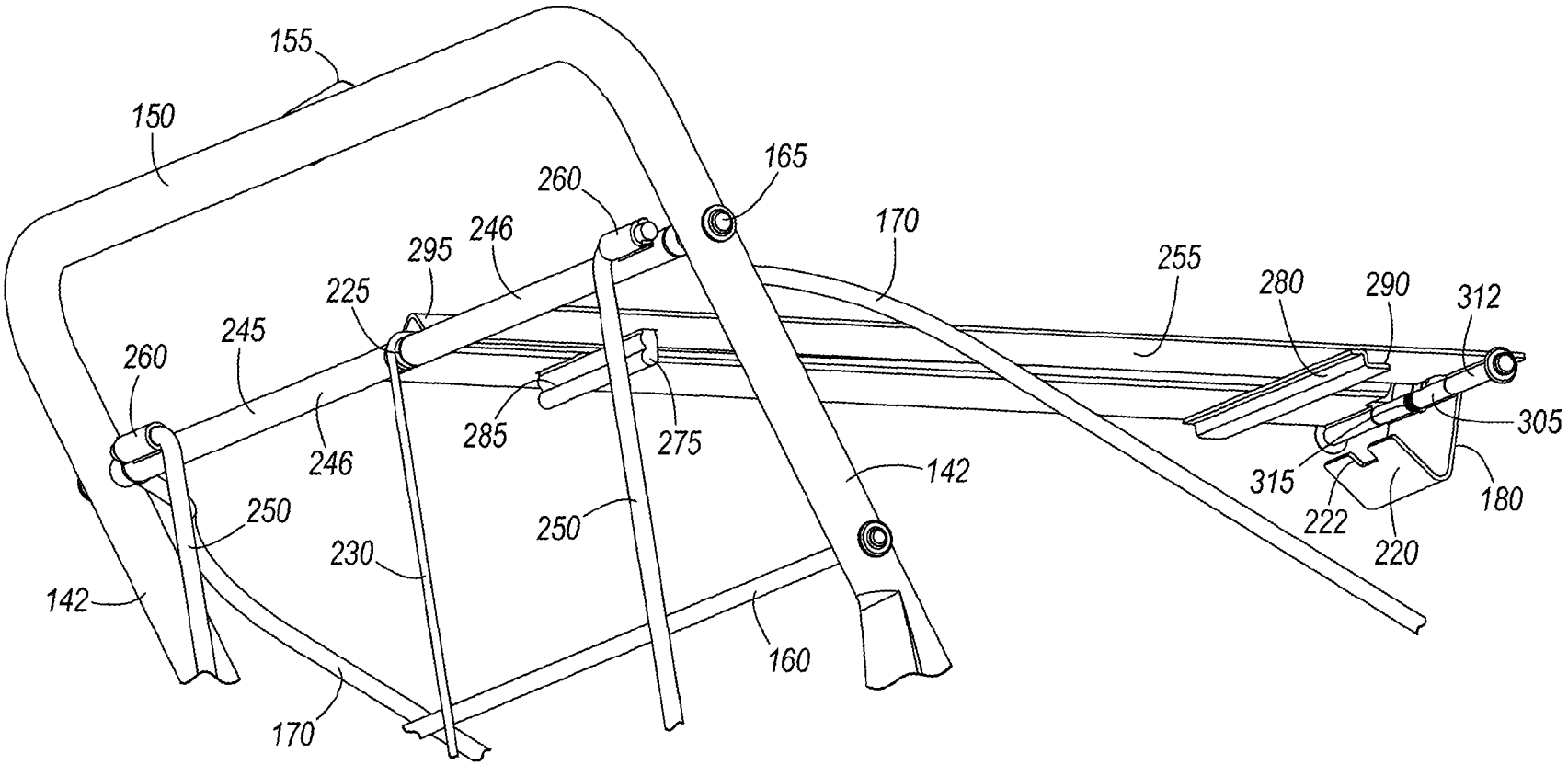
FIG. 5 is a perspective view of the upper portion of the caddy.
Figure 5A:
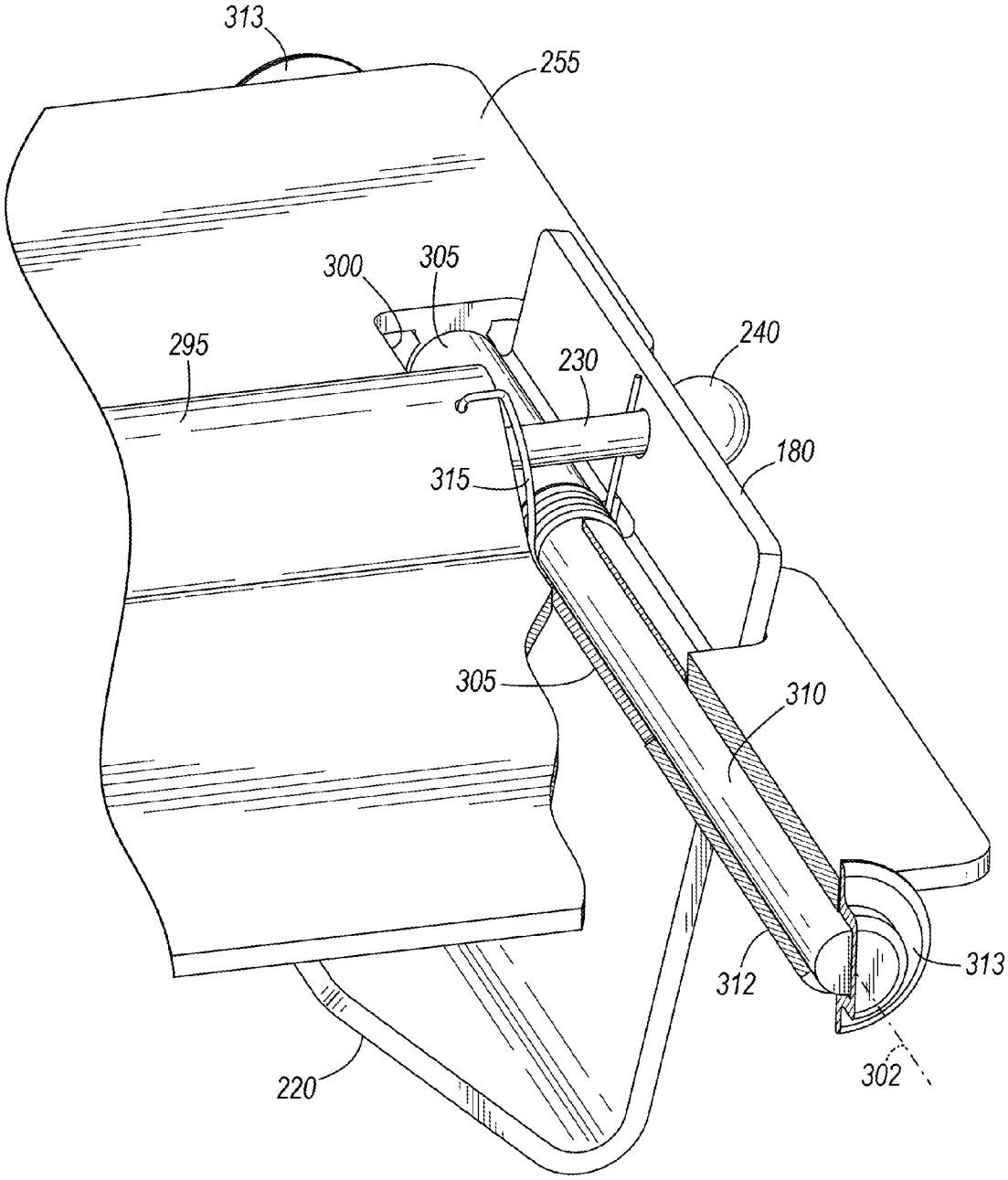
FIG. 5*a* is a perspective view from beneath of an enlarged portion of the caddy as shown in FIG. 5.

FIGS. 1 and 5 show that the frame 105 further includes a linkage support or rod 165 that extends horizontally between the side portions 142 below the handle 150. Only the ends of the rod 165 are visible in the drawings. A generally U-shaped retainer 170 has legs pivotably coupled to the rod 165 adjacent the side portions 142. The retainer is pivotable between a lower position (shown in the drawings) in which the retainer 170 wraps around three sides of the container 15 and limits forward movement of the container 15 relative to the caddy 20, and an upper position (not shown) in which the retainer 170 permits removal of the container 15 from the caddy 20.

With reference to FIGS. 1, 2 and 4, the cart 10 also includes a hands-free mechanism 175, a latch 180, a first or latch linkage 185 coupled between the hands-free mechanism 175 and the latch 180, and a second or cover linkage 190 coupled between the cover 55 and the hands-free mechanism 175.

The hands-free mechanism 175 includes a generally U-shaped foot pedal 195 with parallel side legs 196 extending in a front-to-back direction, and a front portion 197 extending between the front ends of the side legs 196. The rear ends of the side legs 196 are pivotably coupled to the caddy 20 at the axle 125 adjacent respective axle support portions 120, so that the entire foot pedal 195 is pivotable relative to the caddy 20 about a generally horizontal axis. Each of the side portions 196 has thereon a U-shaped extension 198. The extensions 198 are accessible from the sides of the caddy, and the front portion 197 is accessible from the front of the caddy, such that the foot pedal 195 is accessible from adjacent the front and both sides of the caddy 20. The foot pedal also includes (see FIG. 7) a horizontal support rod 205 located forward of the axle 125. The support rod 205 extends between and is welded to the side portions 196 to limit lateral sliding movement of the ends of the side portions 196 toward each other. Springs 200 (see FIGS. 4 and 12*a*) on opposite sides of the caddy are connected between the forward-most frame support 135 and respective extensions 198 of the foot pedal 195 to bias the foot pedal 195 to an up or normal position (FIG. 9*b*). The foot pedal is coupled to the latch linkage 185 and to the cover linkage 190 as described below.

Figure 7:
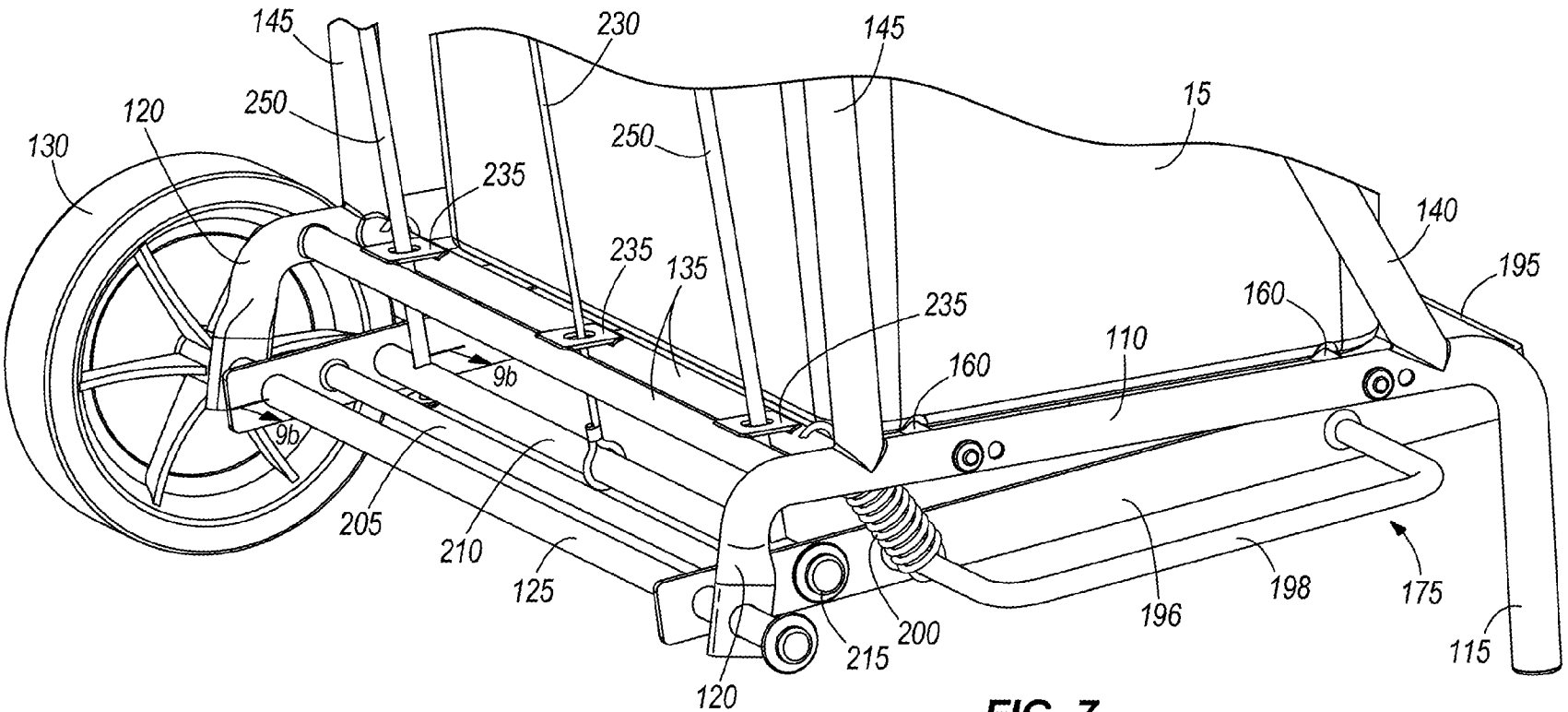
FIG. 7 is a perspective view of a lower portion of the cart showing the container and a hands-free mechanism.

FIGS. 2 and 7 show that the hands-free mechanism 175 also includes a linkage connector or actuating rod 210 located forward of the support rod 205 but adjacent the rear end of the foot pedal 195. Opposite ends of the actuating rod 210 extend through apertures (not shown) in the side portions 196, and each end of the actuating rod is attached to the respective side portion 196 by a fastener 215 (e.g., a cap fastener, a circlip, a through-bolt, a pin, etc.) that permits relative pivotal movement between the foot pedal 195 and the actuating rod 210 during operation of the hands-free mechanism 175.

The latch 180 (see FIGS. 1, 4, 5 and 5*a*) is located between the container 15 and the cover 55 to releasably hold the cover 55 in the closed position. Specifically, in the illustrated construction, the latch 180 is pivotably mounted on a portion of the cover linkage 190, as described below. In this manner, the latch 180 is coupled to the cover 55 via the cover linkage 190. The latch 180 includes an angled container engagement portion 220 that is engageable with the flange 40 of the container 15 to hold the cover 55 in the closed position. With reference to FIGS. 5 and 6, the container engagement portion 220 has therein a recess 222 and engages the underside of the flange 40 such that one of the ribs 50 extends into the recess 222. The latch 180 has a latched state (FIGS. 3*a* and 6) in which the latch 180 is engaged with the container 15 to inhibit movement of the cover 55 to the open position, and an unlatched state (FIG. 8) in which the latch 180 is disengaged from the container 15 to permit movement of the cover 55 to the open position.

The hands-free mechanism 175 is coupled to the container 15 and engaged with the cover 55 via the cover linkage 190 to move the cover 55 between the open position and the closed position. As illustrated in FIGS. 2-5*a*, the cover linkage 190 includes a tubular member 245 that surrounds and is pivotable about the rod 165, connector rods 250 that extend upward from the actuating rod 210 to the tubular member 245, and a cover plate 255 that is attached to the tubular member 245.

The tubular member 245 is actually two tube segments 246 (see FIG. 5) spaced from each other along the rod 165. As described below, the two segments 246 pivot together about the rod 165, so the tubular member 245 can be considered a unitary member. Pivot guides or tubes 260 are longitudinally disposed on respective segments 246 of the tubular member 245 adjacent the opposite ends of the tubular member 245. The pivot guides 260 pivotably attach upper ends of respective connector rods 250 to the tubular member 245. The upper ends of the connector rods 250 are bent at a ninety-degree angle and extend into respective pivot guides 260 such that the ends of the rods 250 are pivotable relative to the tubes 260.

Figure 12A:
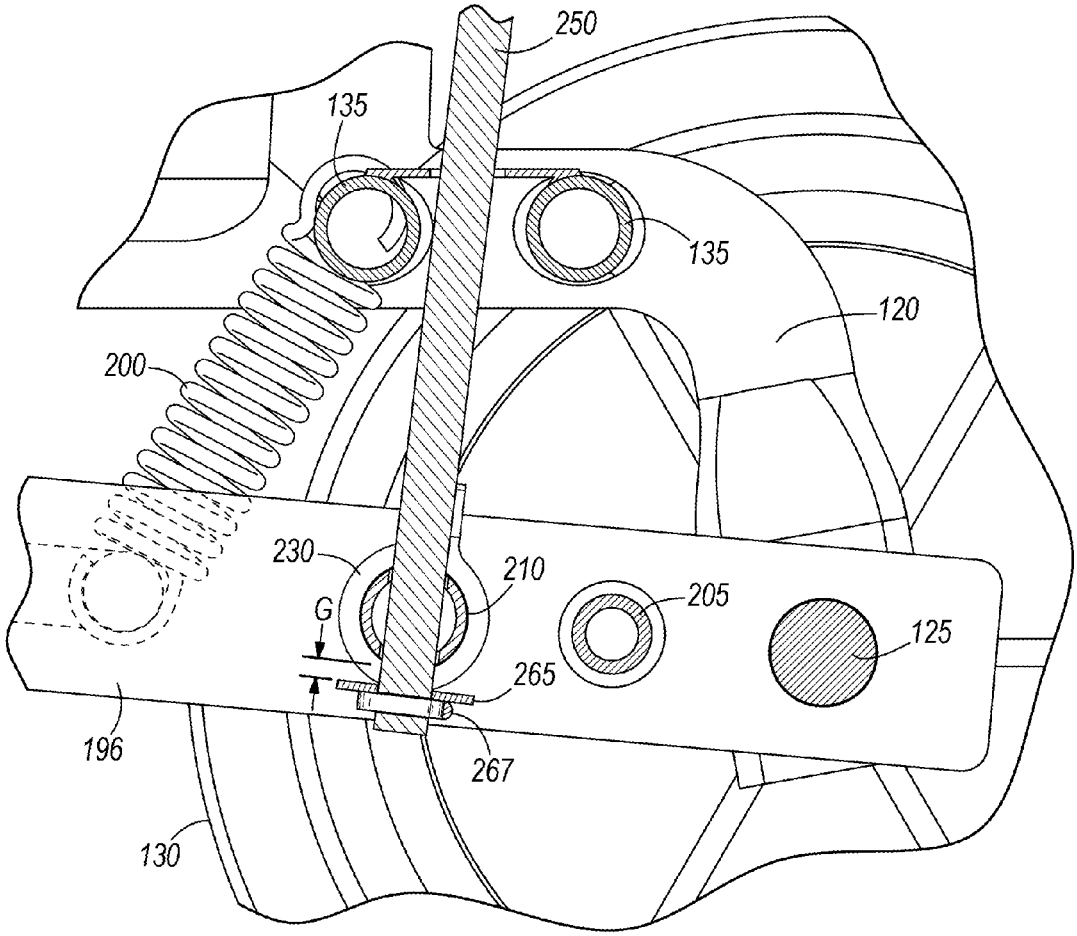
FIG. 12*a* is a section view taken along line 12*a* -12*a* of FIG. 2 with the foot pedal in the normal position and the cover in the closed position.
Figure 12B:
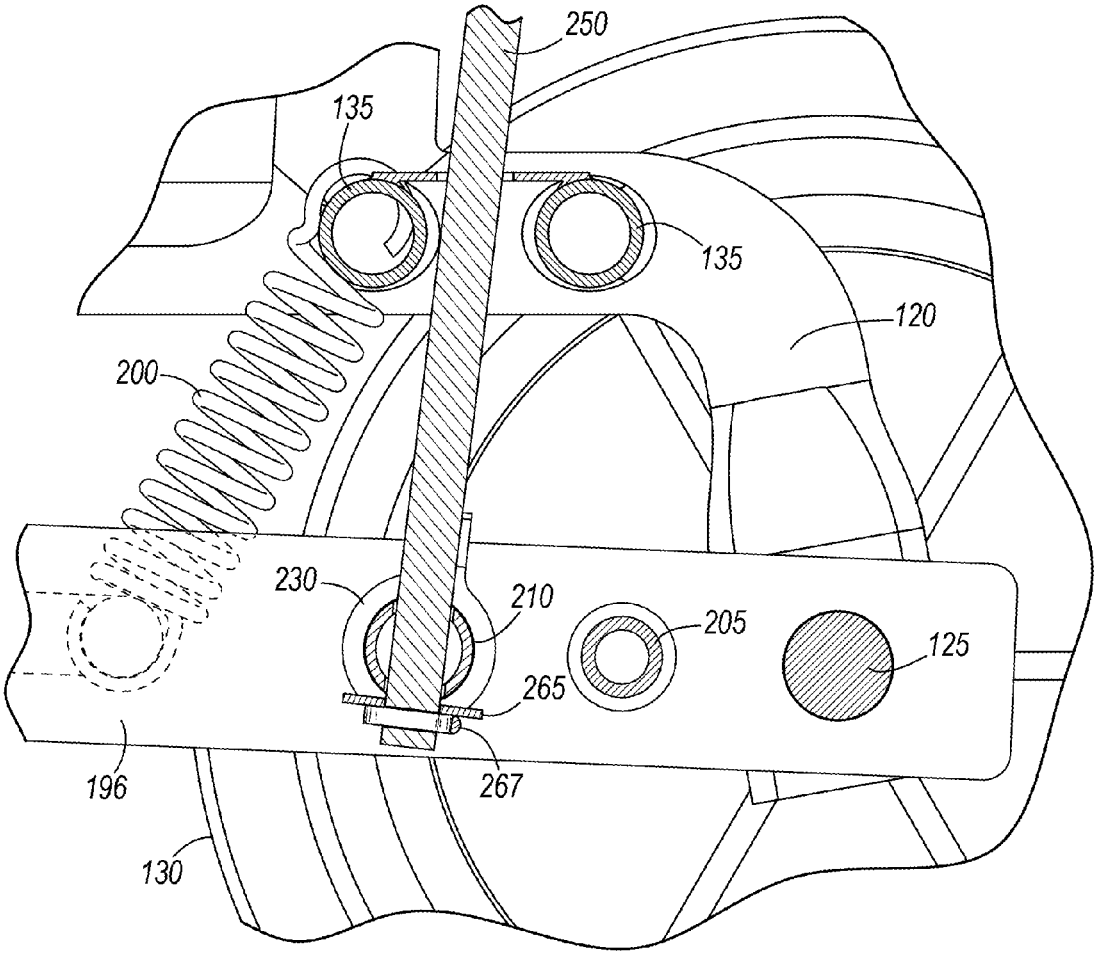
FIG. 12*b* is a view similar to FIG. 12*a* with the foot pedal in the intermediate position and the cover in the closed position.

With reference to FIG. 7, the connector rods 250 pass through apertures in guide plates 235, which are mounted on and extend between the frame supports 135. The lower ends of the connector rods 250 extend through the actuating rod 210, as best shown in FIGS. 12*a* and 12*b*. A washer 265 is coupled to the lower end of each of the connector rods 250 so that each washer 265 is spaced (see FIG. 12*a*) a small distance or gap G (e.g., 0.075 inches, 0.10 inches, etc.) below the actuating rod 210 when the foot pedal 195 is in the normal position and the cover 15 is closed. The washers 265 are held on the rods 250 with pins 267, although lock nuts or other suitable means can be used. When the foot pedal 195 is pushed down, the actuating rod 210 initially moves relative to the rods 250, which remain stationary, until the gap between the connector 210 and the washers 265 is closed. When the gap is closed, the actuating rod 210 engages the washers 265, and subsequent downward movement of the foot pedal and the actuating rod 210 pushes on the washers 265 and causes downward movement of the rods 250. There is thus a lost-motion connection between the actuating rod 210 and the connector rods 250. As further described below, downward movement of the rods 250 opens the cover 55. Devices other than washers (cap fasteners, pins, through-bolts, etc.) can be used on the lower ends of the rods 250.

As illustrated, the rearward end of the plate 255 is welded or otherwise connected to each of the segments 246 of the tubular member 245 so that the two segments pivot together and so that the plate 255 pivots with the tubular member 245 about a horizontal axis 270 (FIG. 4) extending through the rod 165. With reference to FIGS. 3*a*, 3*b*, and 5, the plate 255 extends over the cover 55 adjacent the recessed sections 80 such that the plate 255 is partially recessed relative to the cover 55.

The plate 255 has (see FIGS. 3*a* and 3*b*) a rear engagement portion 275 that is engaged with the rear attachment section 85, and a front engagement portion 280 that is engaged with the front attachment section 90. The engagement portions 275, 280 are located on the underside of the plate 255 and cooperate with each other to attach the cover 55 to the cover linkage 190 so that the cover 55 can be moved between the open position and the closed position via the foot pedal 195. The rear engagement portion 275 extends laterally across the underside of the plate 255 near the rearward end of the plate 255 and has (see FIG. 3*b*) a central indentation or depression 285 that frictionally engages the projection 100 of the rear attachment section 85. The rear engagement portion 275 also extends partially into the elongated groove 95 of the rear attachment section 85. The rear engagement portion 275 can be snapped downward into this position, as further described below. As shown in FIG. 3*a*, the front engagement portion 280 is defined by a protrusion 290 extending laterally across the underside of the plate 255 near the forward end of the plate. The protrusion 290 extends into the elongated groove 95 of the front attachment section 90 to hold the plate 255 in engagement with the cover 255 adjacent the forward end of the cover. The plate 255 must be pushed forward relative to the cover 55 to insert the protrusion 290 into the groove 95. Other mechanisms for attaching the plate 255 to the cover 55 are also possible and considered herein. The plate 255 is attached to the cover 55 such that pivotal movement of the tubular member 245 and the plate 255 in response to downward movement of the rods 250 pivots the cover 55 toward the open position.

With continued reference to FIGS. 3*a*, 3*b*, 5, 6, and 8, the plate 255 also includes a raised central rib 295 that extends longitudinally along the center of the plate 255 in the front-to-back direction. The distal or front end of the plate 255 includes (see FIG. 5*a*) a recess or pocket 300 through which the latch 180 extends. The latch 180 is pivotable relative to the plate 255 about a horizontal axis 302, and the front and rear walls defining the recess 300 limit the pivotal movement of the latch. The latch has fixed thereto (e.g., by welding) a pair of cylindrical sleeves 305 spaced from each other along the axis 302. A pivot pin 310 extends through the sleeves 305, and the sleeves 305 and the latch 180 are pivotable about the pin 310. The opposite end portions of the pin 310 are pivotably received in respective cylindrical sleeves 312 fixed (e.g., by welding) to the underside of the plate 255. The opposite ends of the pin 310 have thereon locking caps 313 that prevent the pin 310 from coming out of the sleeves 312. A torsion spring 315 surrounds the pin 310 in the space between the sleeves 305. The spring 315 is coupled to the plate 255 and to the latch 180 so as to bias the latch to its latched state.

The latch linkage 185 includes (see FIGS. 3*b* and 5) a tubular cable guide 225 that surrounds the rod 165 between the segments 246 of the tubular member 245. The cable guide 225 is preferably made of a low-friction material. The latch linkage 185 also includes a cable 230 that extends over the cable guide 225. The cable 230 is operatively coupled to the foot pedal 195 via attachment to the actuating rod 210 by any suitable means (e.g., looped or tied around the actuating rod 210). The attachment is such that downward movement of the connector 210 when the foot pedal is in the normal position and the cover 55 is in the closed position immediately causes downward movement of the cable 230. The cable 230 is routed upward from the actuating rod 210 through a guide plate 235 (FIG. 7) and over the cable guide 225 to the latch 180. The rib 295 on the plate 255 accommodates passage of the cable 230 from the pulley to the latch 180. As illustrated, the cable 230 extends through an opening in the latch 180 and has an enlarged end portion 240 that pulls rearward on the upper end of the latch 180 in response to downward movement of the foot pedal 195.

The latch 180 is movable between a first position (see FIG. 6) corresponding to the latched state and a second position (see FIG. 8) corresponding to the unlatched state. The foot pedal 195 is movable downward a first distance D1 (FIG. 10*b*) from the normal position to a middle or intermediate position (FIGS. 10*b* and 12*b*) to pull on the cable 230 and move the latch 180 from the first position to the second position (unlatched). When the foot pedal reaches the intermediate position, the actuating rod 210 engages the washers 265 so that further downward movement of the foot pedal will pull down on the rods 250. The foot pedal 195 is movable downward an additional or second distance D2 (FIG. 11*b*) beyond the first distance and beyond the intermediate position to a lowermost or down or open position. During movement from the intermediate position to the lowermost position, the foot pedal engages the latch linkage 185 and the cover linkage 190 (i.e., pulls down on the rods 250) to hold the latch 180 in the unlatched state and to move the cover 55 toward the open position. The cover 55 is in the open or up position when the foot pedal 195 is moved from the normal position to the lowermost position. The second distance is in the same direction as the first distance. While in the illustrated construction the second distance is greater than the first distance, this need not be the case.

The retainer 170 is pivoted upward prior to placing the container 15 on the caddy 20. The cover 55 can be attached to the plate 255 before or after the container 15 is placed on the caddy 20. The cover 55 is attached to the plate 255 by inserting the front engagement portion 280 into the front attachment section 90, i.e., by inserting the protrusion 290 into the groove 95. The rear engagement portion 275 is then snapped or pushed into engagement with the rear attachment section 85, i.e., with the projection 100 of the rear attachment section 85. The cover 55 is thus releasably held in engagement with the cover linkage 190 via the plate 255 so that the cover 55 can be opened and closed in response to movement of the cover linkage 190.

Figure 10A:
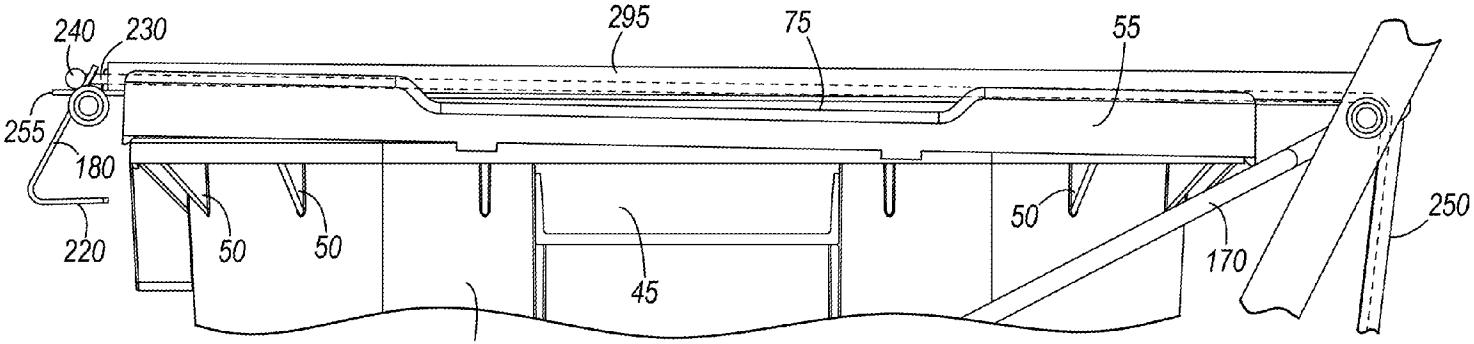
FIG. 10*a* is a view similar to FIG. 9*a* showing the latch in the unlatched state and the cover in the closed position.
Figure 10B:
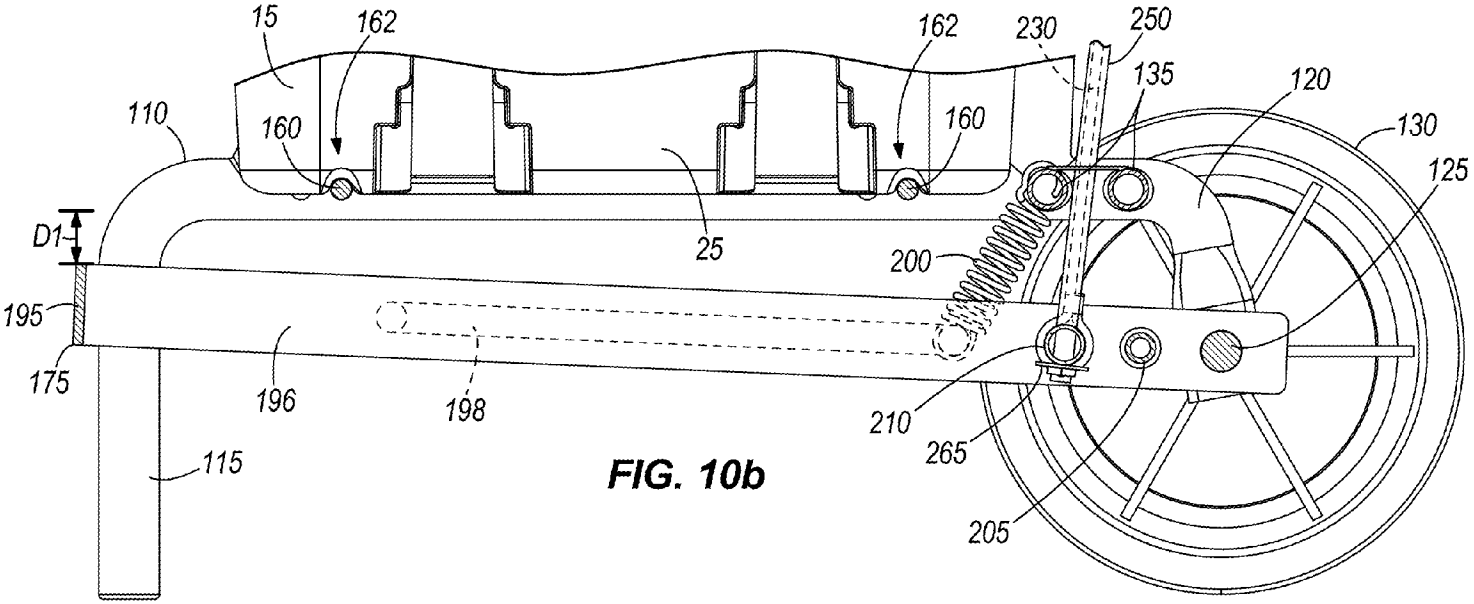
FIG. 10*b* is a view similar to FIG. 9*b* with the foot pedal pushed down to an intermediate position.

FIGS. 1, 3*a*, 3*b*, 6, 9*a*, and 9*b* show the container 15 supported on the caddy 20 with the cover 55 in the closed position, the foot pedal 195 in the normal position, and the latch 180 in the latched state. The latch 180 holds the cover 55 in the closed position when the foot pedal 195 is in the normal position. Technically speaking, the latch 180 cooperates with the plate 255 to hold the cover in the closed position, but once the latch is released (i.e., in the unlatched state), a person can lift the front end of the cover to open the cover. FIGS. 8, 10*a*, and 10*b* show the foot pedal 195 moved or depressed the first distance D1 to the middle or intermediate position to vary the latch 180 from the latched state (FIG. 6) to the unlatched state (FIG. 8). When the foot pedal 195 is moved the first distance, the following happen: (1) the actuating rod 210 moves relative to the connector rods 250 such that the actuating rod 210 just engages the washers 265 attached to the connector rods 250; (2) the actuating rod 210 pulls on the cable 230 so that the latch 180 pivots to disengage the latch 180 from the container 15; (3) the springs 200 are pulled or extended a relatively small amount against their bias; and (4) the cover 55 remains in the closed position due to the lost motion between the bottom of the actuating rod 210 and the connector rods 250.

Figure 11A:
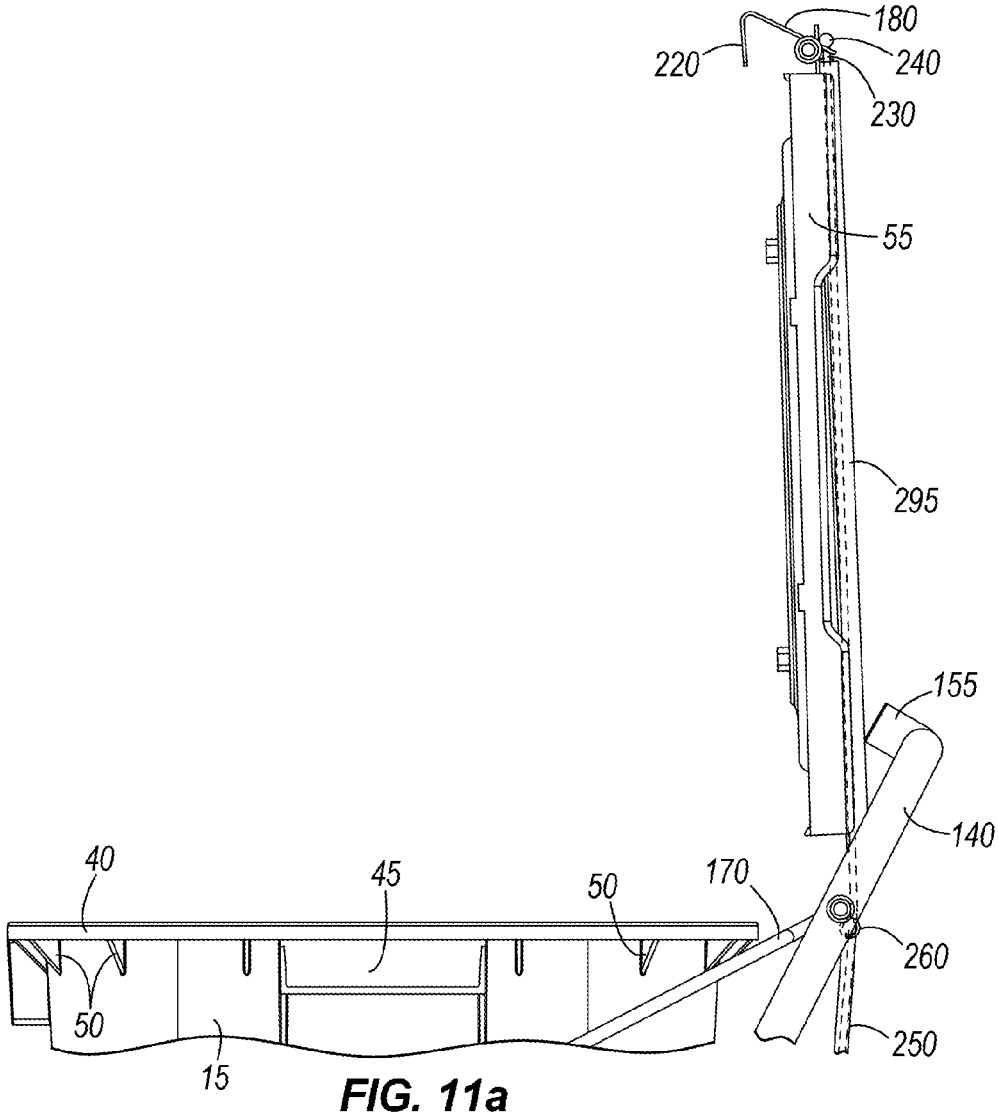
FIG. 11*a* is a view similar to FIG. 9*a* showing the latch in the unlatched state and the cover in an open position.
Figure 11B:
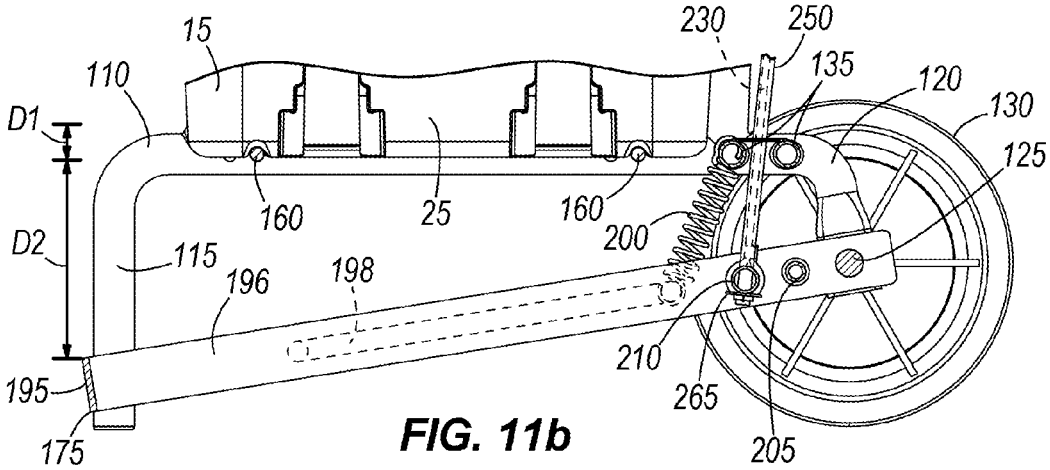
FIG. 11*b* is a view similar to FIG. 9*b* with the foot pedal pushed down to a lowermost position.

FIGS. 11*a* and 11*b* show the foot pedal 195 moved or depressed the second distance to the down position. When the foot pedal 195 is moved the second distance, beyond the first distance, the following happen: (1) downward movement of the actuating rod 210 keeps the cable 230 taut so that the latch 180 is held or remains in the unlatched state; (2) the actuating rod 210 pulls the connector rods 250 downward due to engagement of the actuating rod 210 with the washers 265, and downward movement of the connector rods 250 pulls on the pivot guides 260, which pivots the tubular member 245 and the plate 255 about the axis 270, thereby moving the cover 55 to the open position; and (3) the springs 200 are pulled or extended a relatively large amount against their bias.

With reference to FIG. 11*a*, the plate 255 hits the stop 155 when the cover 55 is in the open position. As illustrated, the cover 55 defines an angle of less than ninety degrees relative to the horizontal plane defined by the flange 40. As such, when the cover is in the open position, gravity biases the cover toward the closed position, but the cover will remain up as long as the foot pedal is depressed. Also, the latch 180 remains in the unlatched state as long as the foot pedal 195 is depressed.

Upon release of the foot pedal 195, the springs 200 pull the foot pedal 195 upward to the normal position. Movement of the foot pedal 195 and the actuating rod 210 back to the normal position removes the downward force on the washers 265 so that the connector rods 250 are free to move upward. Once the connector rods are no longer holding the cover 55 up, gravity causes the cover to drop to the closed position. Normally, an operator will lift his or her foot slowly so that the foot pedal 195 moves up slowly and the cover closes slowly. The latch 180 remains in the unlatched state until the cover 55 reaches the closed position. At that point the tension on the cable 230 is removed, which removes the force on the latch 180, and the latch 180 returns to the latched state due to the bias provided by the spring 315.

In alternative embodiments, the cover 55 can define an angle of ninety degrees or more in the open position, but then a force other than gravity, such as springs biasing the rods 250 upward, would be needed to close the cover.

The hands-free mechanism 175 disengages the latch 180 from the container 15 to permit movement of the cover 55 to the open position. The hands-free mechanism 175, the latch linkage 185, and the cover linkage 190 cooperate with each other to sequentially vary the latch 180 to the unlatched state and open the cover 55. The sequential operation of the latch linkage 185 and the cover linkage 190 minimizes the steps needed to move the cover 55 from the closed position to the open position. Stated another way, the hands-free mechanism 175, the latch linkage 185, and the cover linkage 190 disengage the latch 180 from the cover 55 via operation of the same foot pedal 195 that opens the cover 55.

The retainer 170 and the frame 105 hold the container 15 on the caddy 20. Absent a force on the foot pedal 195, the bias of the latch 180 to the latched state holds the cover 55 in the closed position so that in the event the cart 10 is tipped over, the cover 55 remains in the closed position and the contents of the container 15 remain within the interior space 35. Movement of the foot pedal 195 the first distance D1 from the normal position engages the latch linkage 185 without engaging the cover linkage 190 to vary the latch 180 to the unlatched state. The latch 180 is temporarily moved against the bias of the spring 315 by the foot pedal 195 to permit movement of the cover 55 to the open position when the foot pedal 195 is moved the additional second distance D2. The latch 180 is held against the bias by the hands-free mechanism 175 and the latch linkage 185 when the hands-free mechanism 175 and the cover linkage 190 are manipulated to move the cover 55 between the closed position and the open position. That is, the latch 180 is held in the unlatched state whenever the foot pedal 195 is not in the normal position.

Various features and advantages of the invention are set forth in the following claims.

The invention claimed is:

1. A cart comprising:

a container defining an interior space;

a cover removably securable to the container and movable relative to the container between an open position providing access to the interior space and a closed position inhibiting access to the interior space;

a caddy removably supporting the container, the caddy including a plate engaged with and disposed over the cover and a latch attached to the plate and engageable with the container to releasably hold the cover in the closed position, the caddy further including a hands-free mechanism coupled to the latch and operable to disengage the latch from the container to permit movement of the cover to the open position, the hands-free mechanism further engaged with the cover via the plate to move the cover between the open position and the closed position; and wherein the cover is removably securable to the container independent of the caddy, and wherein the container with the cover secured thereon are removable from the caddy for disposal of the contents from the container.

2. The cart of claim 1, wherein the latch is coupled to the cover and biased into engagement with the container, and wherein the hands-free mechanism is configured to disengage the latch from the container prior to moving the cover from the closed position to the open position.

3. The cart of claim 1, wherein the plate is pivotable in response to operation of the hands-free mechanism to pivot the cover to the open position.

4. The cart of claim 3, wherein the latch is pivotably coupled to an end of the plate.

5. The cart of claim 1, wherein the latch is biased to hold the cover in the closed position, and wherein the latch is configured to be temporarily moved against the bias to permit movement of the cover to the open position.

6. The cart of claim 5, wherein the latch is held against the bias by the hands-free mechanism when the cover moves between the open position and the closed position.

7. The cart of claim 1, further comprising a first linkage coupled between the hands-free mechanism and the latch and movable by the hands-free mechanism to disengage the latch from the container, and a second linkage including the plate and coupled between the hands-free mechanism and the cover, the second linkage movable by the hands-free mechanism to move the cover between the open position and the closed position.

8. The cart of claim 7, wherein the hands-free mechanism includes a foot pedal coupled to the first linkage and the second linkage, and wherein the foot pedal engages the first linkage to disengage the latch and engages the second linkage to move the cover to the open position.

9. A cart comprising:

a container defining an interior space;

a cover movable between an open position providing access to the interior space and a closed position inhibiting access to the interior space;

a latch coupled to the cover and having an unlatched state permitting movement of the cover to the open position and a latched state inhibiting movement of the cover to the open position; and a hands-free mechanism coupled to the container and the latch, the hands-free mechanism movable a first distance to vary the latch from the latched state to the unlatched state, and the hands-free mechanism movable a second distance beyond the first distance to move the cover from the closed position to the open position.

10. The cart of claim 9, wherein the hands-free mechanism includes a foot pedal, the cart further comprising a first linkage coupled between the latch and the foot pedal and a second linkage coupled between the cover and the foot pedal, and wherein the foot pedal is movable the first distance relative to the second linkage to vary the latch to the unlatched state.

11. The cart of claim 10, wherein the latch is movable between a first position corresponding to the latched state and a second position corresponding to the unlatched state, and wherein the foot pedal engages the first linkage to move the latch from the first position to the second position and engages the second linkage to move the cover to the open position.

12. The cart of claim 9, wherein the hands-free mechanism includes a foot pedal, the cart further comprising a first linkage coupled between the latch and the foot pedal and a second linkage coupled between the cover and the foot pedal, and wherein the foot pedal has a normal position in which the latch is in the latched state and the cover is in the closed position.

13. The cart of claim 12, wherein movement of the foot pedal the first distance from the normal position engages the first linkage without engaging the second linkage to vary the latch to the unlatched state, wherein movement of the foot pedal an additional second distance beyond the first distance engages the first linkage and the second linkage to hold the latch in the unlatched state and to move the cover toward the open position.

14. The cart of claim 12, wherein the second linkage includes a plate engaged with the cover and pivotable about an axis to pivot the cover toward the open position in response to movement of the foot pedal.

15. The cart of claim 9, wherein the latch is biased to the latched state to hold the cover in the closed position, and wherein the latch is configured to be temporarily varied to the unlatched state to permit movement of the cover to the open position.

16. The cart of claim 15, wherein the latch remains in the unlatched state when the cover moves between the closed position and the open position.

17. A cart comprising:

a container defining an interior space;

a cover movable between an open position providing access to the interior space and a closed position inhibiting access to the interior space;

a latch variable between an unlatched state in which the latch is disengaged from one of the container and the cover to permit movement of the cover to the open position, and a latched state in which the latch is engaged with the one of the container and the cover to inhibit movement of the cover to the open position; and a caddy supporting the container, the latch coupled between the caddy and the container, the caddy including a hands-free mechanism having a foot pedal operatively coupled to the latch and the cover to vary the latch between the latched state and the unlatched state and to move the cover from the closed position to the open position.

18. The cart of claim 17, wherein the hands-free mechanism includes a foot pedal, the cart further comprising a first linkage coupled between the latch and the foot pedal, and a second linkage coupled between the cover and the foot pedal, and wherein the foot pedal has a normal position in which the latch is in the latched state and the cover is in the closed position.

19. The cart of claim 18, wherein movement of the foot pedal a first distance from the normal position engages the first linkage without engaging the second linkage to vary the latch to the unlatched state, and wherein movement of the foot pedal an additional second distance beyond the first distance engages the first linkage and the second linkage to hold the latch in the unlatched state and to move the cover toward the open position.

20. The cart of claim 19, wherein the caddy has a frame member, wherein the second linkage has a tubular member at least partially surrounding the frame member and a rod coupled between the foot pedal and the tubular member and movable in response to movement of the foot pedal the second distance, and wherein the tubular member is pivotable about the frame member to pivot the cover toward the open position in response to movement of the rod.

21. The cart of claim 20, wherein the cover pivots about an axis, and wherein movement of the foot pedal the second distance engages the second linkage to pivot the cover about the pivot point toward the open position.

22. The cart of claim 21, wherein the second linkage includes a plate engaged with the cover and pivotable about an axis, and wherein movement of the foot pedal the second distance engages the second linkage to pivot the plate and the cover about the axis toward the open position.

23. The cart of claim 22, wherein the latch is pivotably coupled adjacent a distal end of the plate.

24. The cart of claim 22, wherein the first linkage includes a cable operatively coupled to and routed from the foot pedal to the latch to move the latch to the unlatched state in response to movement of the foot pedal the first distance.

25. The cart of claim 24, wherein the cable extends through the latch.

26. The cart of claim 24, wherein the first linkage further includes a cable guide coupled to the frame member, and wherein the cable is routed over the cable guide and under the plate to the latch.

27. The cart of claim 24, wherein the latch is biased to the latched state to hold the cover closed, and wherein movement of the foot pedal the first distance pulls the cable to move the latch against the bias to the unlatched state.

28. The cart of claim 27, wherein upon release of the foot pedal, the latch returns to the latched state.

29. The cart of claim 16, wherein the latch is biased to the latched state to hold the cover closed, wherein the latch is configured to be temporarily varied to the unlatched state to permit movement of the cover to the open position, and wherein the latch remains in the unlatched state when the cover moves between the closed position and the open position.

30. The cart of claim 9, further comprising a plate disposed over the cover, wherein the latch is attached to an end of the plate.

31. The cart of claim 17, further comprising a plate disposed over the cover, wherein the latch is attached to an end of the plate.

* * * * *